US005256105A

United States Patent [19]

Austin

[11] Patent Number: 5,256,105

[45] Date of Patent: Oct. 26, 1993

[54] WASHABLE SEAMLESS CLEAN ROOM

[75] Inventor: Frank X. Austin, Plymouth, Mich.

[73] Assignee: Clean Air Technology, Inc., Canton, Mich.

[21] Appl. No.: 844,308

[22] Filed: Mar. 2, 1992

[51] Int. Cl.[5] ..... F24F 7/10

[52] U.S. Cl. ..... 454/187; 454/220; 454/232; 52/79.1; 52/484

[58] Field of Search ..... 454/187, 220, 232; 52/79.1, 220.6, 220.7, 272, 288; 82/480, 481, 484

[56] References Cited

U.S. PATENT DOCUMENTS

| | | | |
|---|---|---|---|
| 4,506,595 | 3/1985 | Roberts | 454/187 |
| 4,554,766 | 11/1985 | Ziemer | 454/187 X |
| 4,667,579 | 5/1987 | Daw | 52/79.1 X |
| 5,090,163 | 2/1992 | New | 52/489 X |

OTHER PUBLICATIONS

Advertising Brochure, 1990.

*Primary Examiner*—Carl D. Friedman
*Assistant Examiner*—Beth A. Aubrey
*Attorney, Agent, or Firm*—Harness, Dickey & Pierce

[57] ABSTRACT

A modular clean room structure in which the interior is finished without any seams between adjacent modules or crevices at the corners of the room such that the room can be easily sterilized. The seamless nature of the interior surface of the clean room eliminates locations where moisture can accumulate and promote bacteria growth. A cove is used to finish the corners of the room with a larger radius curve blending smoothly into adjacent flat surfaces. A durable coating is applied continuously over the ceiling, side walls and floor of the clean room to provide a seamless interior surface.

17 Claims, 4 Drawing Sheets

WASHABLE SEAMLESS CLEAN ROOM

BACKGROUND AND SUMMARY OF THE INVENTION

The present invention relates to a clean room and more particularly to a modularly constructed clean room in which there are no seams between adjoining modules, between the floor and side walls or between the side walls and ceiling.

The need for a controlled, contaminant free work area is well recognized in industry. Accordingly, specialized clean rooms have been developed to provide a controlled environment in which operations can be performed with minimal contamination from airborne particles. The atmosphere in a clean room is typically purified from particle contaminants by the use of high efficiency particle air (HEPA) filters.

It is desirable to provide a clean room structure that can be quickly assembled at a user's production facility such that the operation of the production facility is interrupted as little as possible during the construction of the clean room. This is particularly important during an expansion of an existing clean room where it is desirable to reduce, as much as possible, the amount of dust or dirt generated during the construction of the clean room addition. A clean room of modular construction can be prefabricated off-site and assembled at the production facility of the user. Off-site fabrication of the clean room enables the clean room to be assembled using a minimal amount of time and construction space and creating a minimal amount of dust and dirt. With a modularly constructed clean room, between each module, a seam is formed on both the interior and exterior sides of the clean room wall. In addition, a seam is formed at the corners between adjacent side walls as well as at the corners between the side walls and floor and between the side walls and ceiling. Such seams can be sealed, producing a clean room structure that does not allow any contaminated air to enter the room at the seams. As such, modular construction can effectively be used for industrial clean room applications where the primary desire is to eliminate particle contaminants from the atmosphere within the clean room.

However, in some clean room applications such as in the pharmaceutical industry, where sterile filling operations are performed, not only is it required that particulate contamination be removed from the atmosphere, but also that the interior of the clean room be sterile. A sterile environment is maintained by periodic washing of the interior side walls, ceiling and floor surfaces with a sterilizing solution. However, at each seam or at each corner crevice, an opportunity exists for moisture to collect and bacteria to grow, compromising the sterile environment.

Accordingly, it is an objective of the present invention to provide a modularly constructed clean room with a seamless interior surface and without corner crevices to enable the interior of the clean room to be washed and sterilized without opportunity for moisture to collect.

The modular clean room of the present invention eliminates corner crevices between adjacent side walls, between side walls and the floor and between side walls and the ceiling by placing a radiused cove molding in each corner that is smoothly joined with the side walls, floor and ceiling. A joint filler is used to provide a smooth, tangential transition from the flat surfaces to the radiused cove surface without any crevices for the accumulation of moisture etc. A durable coating is then applied to the floor, side walls and ceiling to form a continuous inner surface without any seams. A preferred coating is an epoxy paint with an anti-bacterial agent to retard bacteria growth. Return air ducts within the wall modules have one piece molded return air intakes that are mounted flush with the wall and covered with the coating to avoid any seams. In addition, the air intakes are contoured with smooth walls avoiding any crevices so as to be easily washed.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
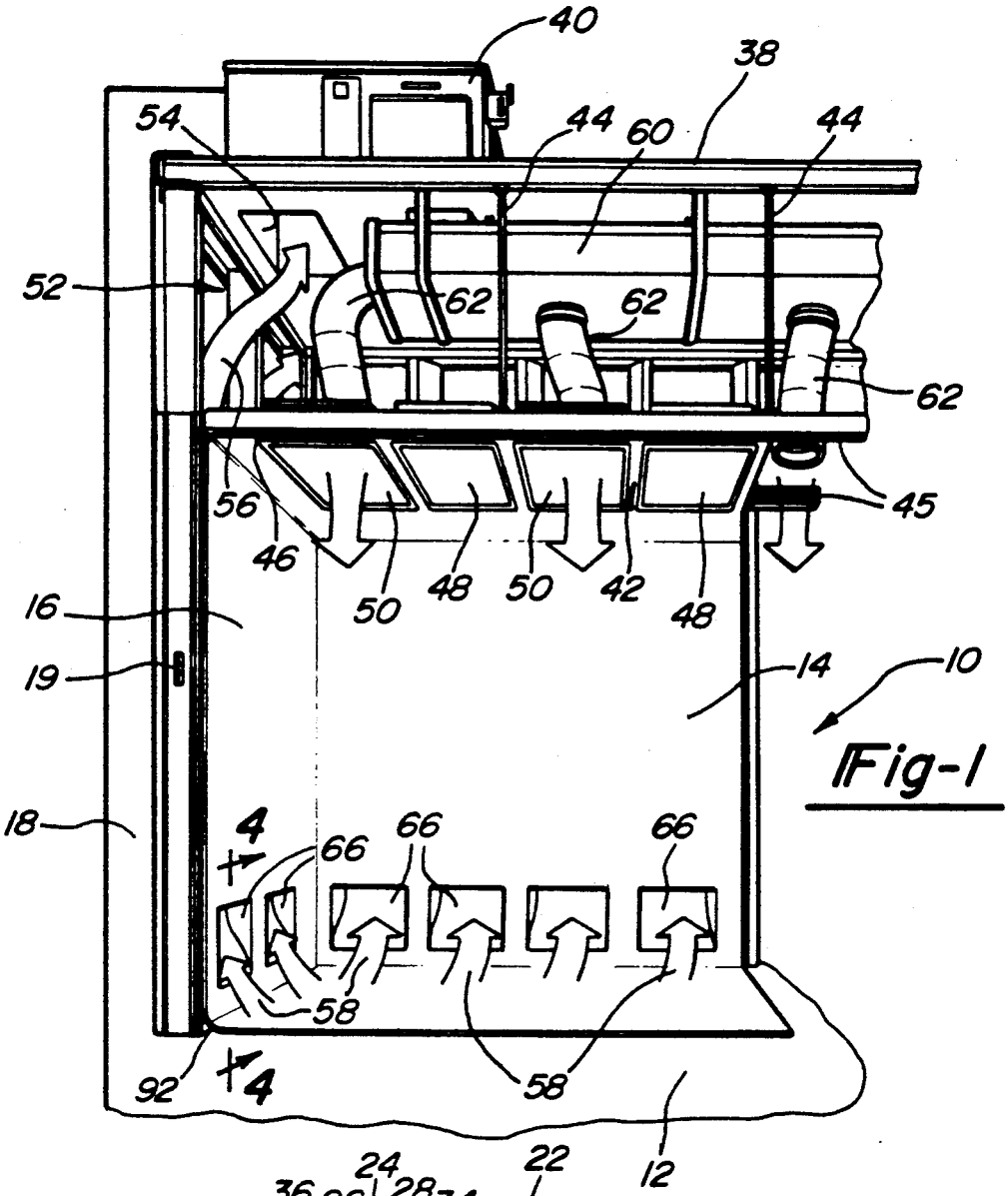
FIG. 1 is a fragmentary perspective view of a clean room of the present invention.

The modular clean room of the present invention as shown in FIG. 1 and designated generally at 10. Clean room 10 is of a modular construction and is built on top of a concrete slab floor 12. While concrete is a preferred floor material, other floor materials can be used without departing from the scope of the present invention. Cleaning room 10 is constructed of a plurality of upright side walls, such as side wall 14 and side wall 16 that are positioned normal to one another forming an enclosed area for the clean room. The side walls 14 and 16 are constructed from a plurality of modules 18 that are fastened together along their upright side edges with fasteners 19. The fasteners 19 that couple the wall modules together are the same as disclosed in U.S. Pat. No. 5,029,519 issued Jul. 9, 1991, commonly assigned and incorporated herein by reference. The fasteners 19 can be operated by access openings in the exterior of the clean room where the access openings can be concealed with trim strips as disclosed in the referenced U.S. patent.

The modules 18 are constructed of two or more C-shaped framing studs 22 with one stud at each vertical edge of the module. An inner panel 24 is attached to one side of the framing stud while an outer panel 26 is attached to the opposite side. The inner panel is formed of a composite structure having a particle board core 28 with a high pressure laminates 30 and 32 bonded to the surfaces of the core 28. The outer panel 26 is similarly constructed with a particle board core 28, and high pressure laminates 34 and 36 bonded thereto.

An upper deck 38 is constructed at the upper end of the side walls. The upper deck supports air conditioning equipment 40 that is used to heat or cool and regulate the humidity of the air within the clean room. A modular ceiling 42 is suspended from the upper deck by hangers 44. The modular ceiling 42 is constructed of a plurality of ceiling modules constructed with C-shaped framing studs 45 having a composite inner panel 46 attached thereto. The composite inner panel has a particle board core 47 and a high pressure laminate 49 bonded thereto on both sides. Light fixtures 48 and HEPA filters 50 are installed in openings in the inner panels of the modular ceiling as shown in FIGS. 6 and 7.

Figure 6:
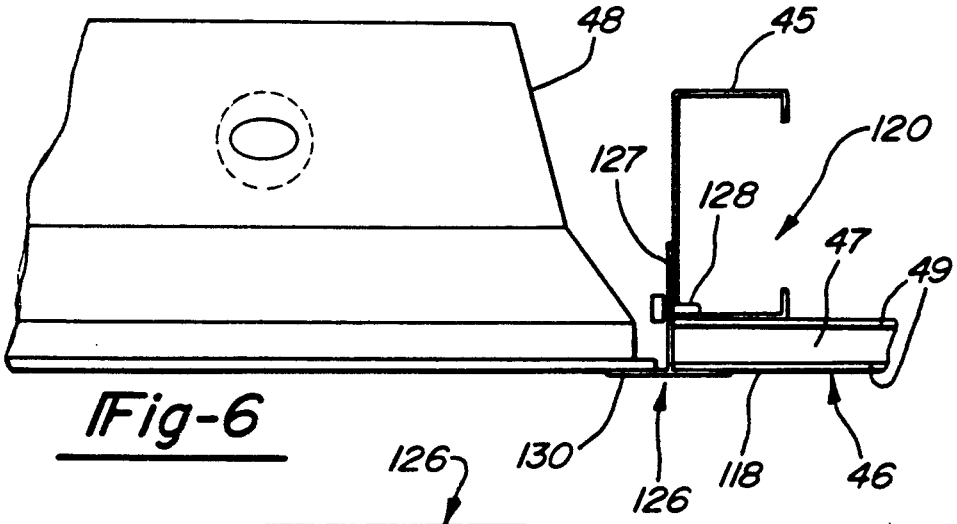
FIG. 6 is a fragmentary sectional view of a portion of a clean room ceiling illustrating a channel used to mount ceiling figures.

With reference to FIG. 6, the ceiling structure is shown in greater detail. The ceiling module 120 is formed by C-shaped framing member 122 with an inner panel 46 attached thereto. The inner panel 46 is covered with the epoxy coating 118 described below. The openings in the ceiling for the lights 48 and HEPA filters 50 are framed by a stainless steel inverted T-channel 126. Stainless steel is used because it will not react with the sterilizing agents used to clean the clean room. The upright portion of the T- channel 127 is fastened to the framing member 122 by fasteners 128. One half of the T-cross bar 130 extends into the opening in the panel 46 forming a ledge to support the light or filter. The other half of the T-crossbar overlays the coating 118 on the ceiling.

Figure 7:
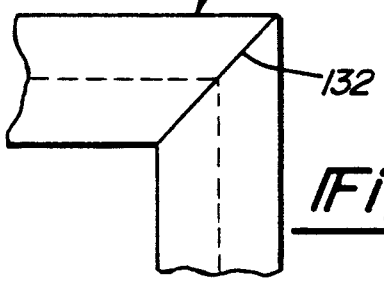
FIG. 7 is a fragmentary plan view of the fixture mounting channel.

With reference to FIG. 7, it can be seen that the T-channel 126 forming the frame around the opening for the lights and filters is formed with mitered corners 132. At the corners, the adjoining pieces of the T-channel 126 are welded together to form a rigid single piece frame. The weld is formed on a back side of the T-channel and silver solder is applied on the interior surface of the channels and polished smooth.

The space between the inner and outer panels 24 and 26 of the side wall modules forms air ducts within the wall modules having air intakes 66 at their lower ends. Air is drawn from the clean room interior into the air duct as shown by the arrows 58. The air ducts are open at the upper end into the plenum 52 formed between the deck and ceiling. The air conditioning equipment 40 has an air inlet 54 in communication with the plenum 52 and draws air into the air conditioning equipment such that a reduced air pressure is created in the plenum 52, forming a negative air pressure plenum. The negative air pressure within the plenum draws air from the room through the air ducts and plenum into the air conditioning equipment as shown by arrow 56. Once conditioned, the air is directed through air duct 60 to distribution tubes 62 where he air passes through the HEPA filters 50 and back into the clean room. The negative pressure plenum above the clean room helps prevent any contamination from entering the clean room through the ceiling. Since the interior pressure of the clean room is higher than the air pressure in the plenum, if any air leaks were to exist in the ceiling, the direction of air flow would be from the room interior to the exterior. If a negative pressure plenum above the ceiling is not desired, it is possible to connect the air conditioning equipment intake 54 with the side wall module air ducts through an enclosed duct such that the return air from the clean room does not freely circulate in the space between the ceiling and support deck.

Figure 2:
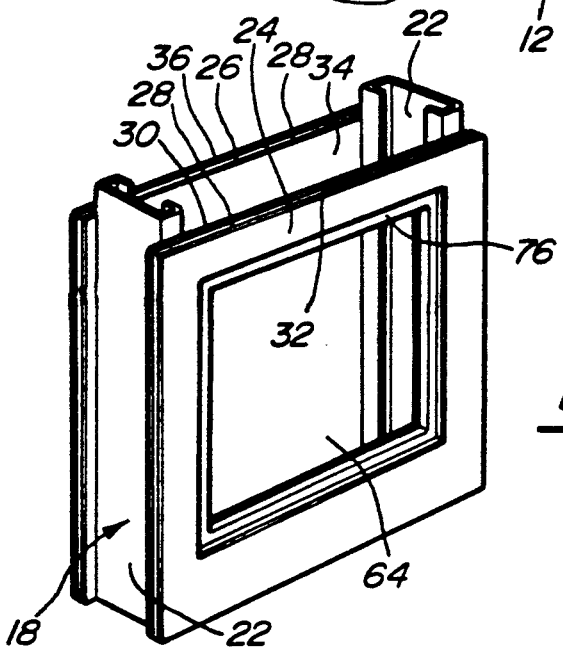
FIG. 2 is a fragmentary perspective view of the lower portion of a side wall module showing an opening for a return air duct.
Figure 3:
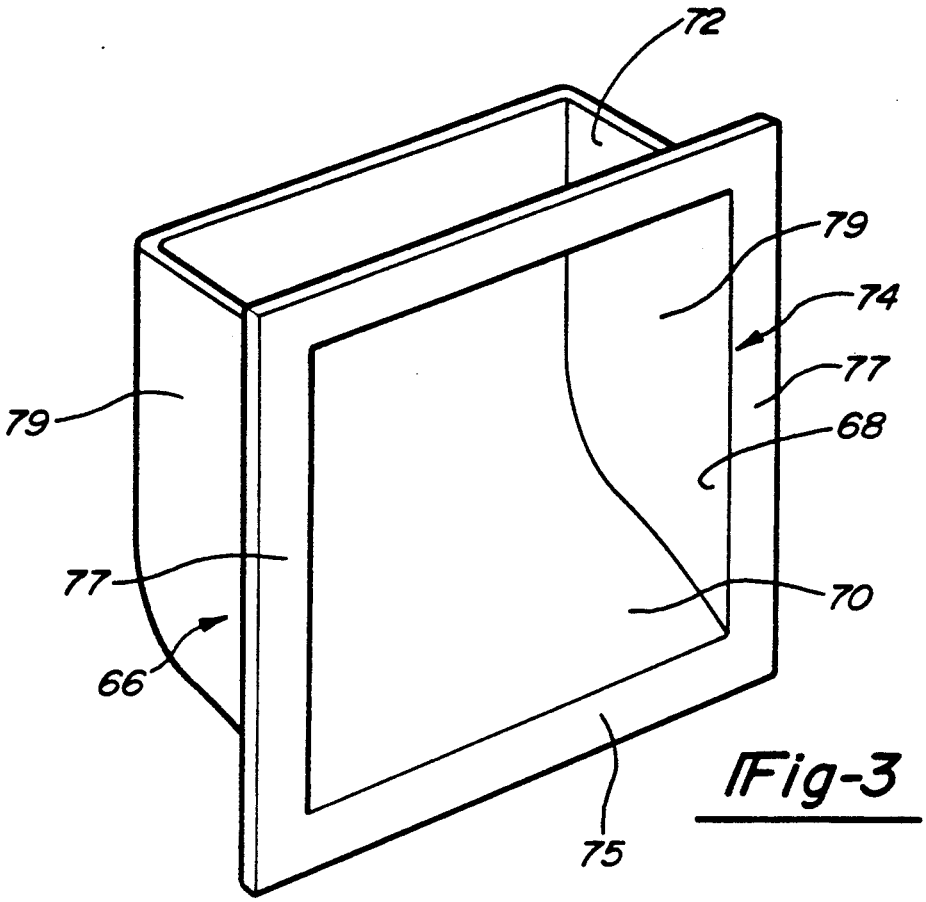
FIG. 3 is a perspective view of a molded return air intake.

The lower end of a module 18 is shown in FIG. 2 with a vertical opening 64 through inner panel 24 for the air intake 66 shown in FIG. 3. The air intake 66 serves as an air scoop having a vertical air intake opening 68 with a curved continuous back and bottom wall 70 leading to a horizontal air outlet 72 outlet 72 is sealed to a stainless steel air duct 78 within the wall module 18. A flange 74 extends outwardly from the opening 68 and is seated into the recess 76 machined into the interior surface of the inner panel 24. The lower horizontal portion 75 of the flange is connected to the back and bottom wall 70. Air intake side panels 79 connect the back and bottom wall 70 with the vertical portions 77 of the flange 74. The air intake 66 is preferably installed in the wall module by gluing the flange 74 into the recess 76 such that the flange is flush with the interior surface of the inner panel. Alternatively, a recessed screw 71 or other fastener can be driven through the flange and into the inner panel 24 to secure the air intake insert to the inner panel.

Figure 4:
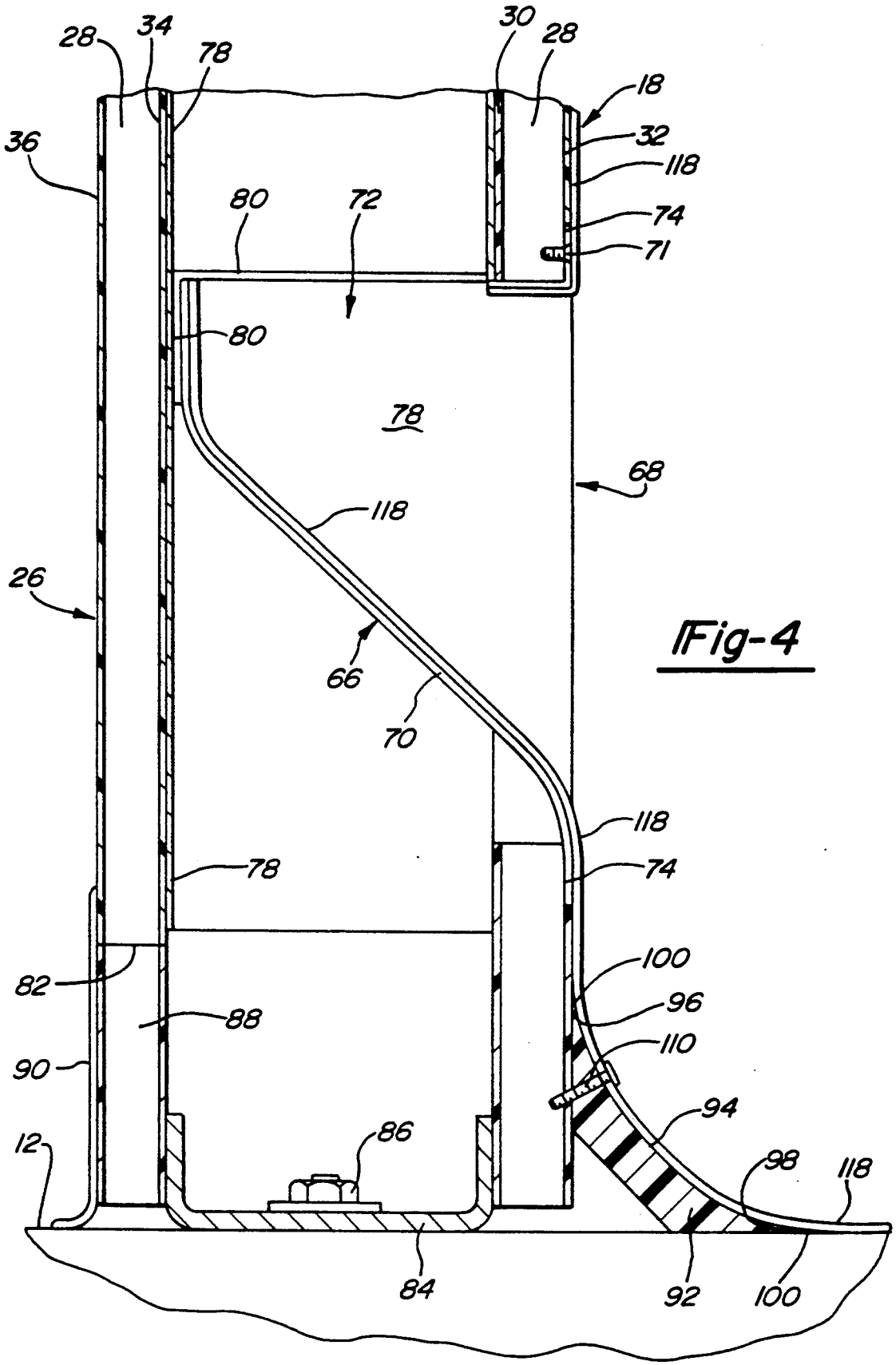
FIG. 4 is a sectional view of the lower end of a wall module as seen from substantially the line 4—4 of FIG. 1.

The air intake 66 is a one piece molded plastic part such that there are no seams, cracks or crevices that can be a site for bacteria growth. With reference to FIG. 4, the air intake is shown installed within a wall module 18. A stainless steel air duct 78 lines the interior of the module 12. The air intake 66 is secured to the stainless steel air duct by a waterproof adhesive 80, preferably a FDA approved silicone sealant at the horizontal outlet 72. Stainless steel is used for the air duct 78 because it will not react with the sterilizing agents used to clean the room.

FIG. 4 also shows additional details of the wall module structure. The outer panel 26 terminates at a lower end 82 that is spaced above the floor 12 by several inches. This provides access to the lower module framing member 84 to enable the module to be fastened to the floor by the nut assembly 86. Once the wall module 18 has been secured to the floor, a removable panel 88 is installed below the lower end 82 of the outer panel 26. A vinyl cove molding 90 is installed over the removable panel and extends above the lower end 82 of the outer panel covering the seam between the outer panel and the removable panel.

The interior corners of the clean room are finished by an extruded plastic cove 92 shown in FIG. 1 at the corner formed by the side wall 16 and the floor 12. The cove has a radiused outer surface 94 that extends in an arc of approximately 90° so that at the two ends 96 and 98 the cove merge smoothly, i.e. tangentially, with the side wall and floor respectively. A joint sealer 100 is placed at the ends 96 and 98 and sanded smooth with the cove and floor or wall.

Figure 5:
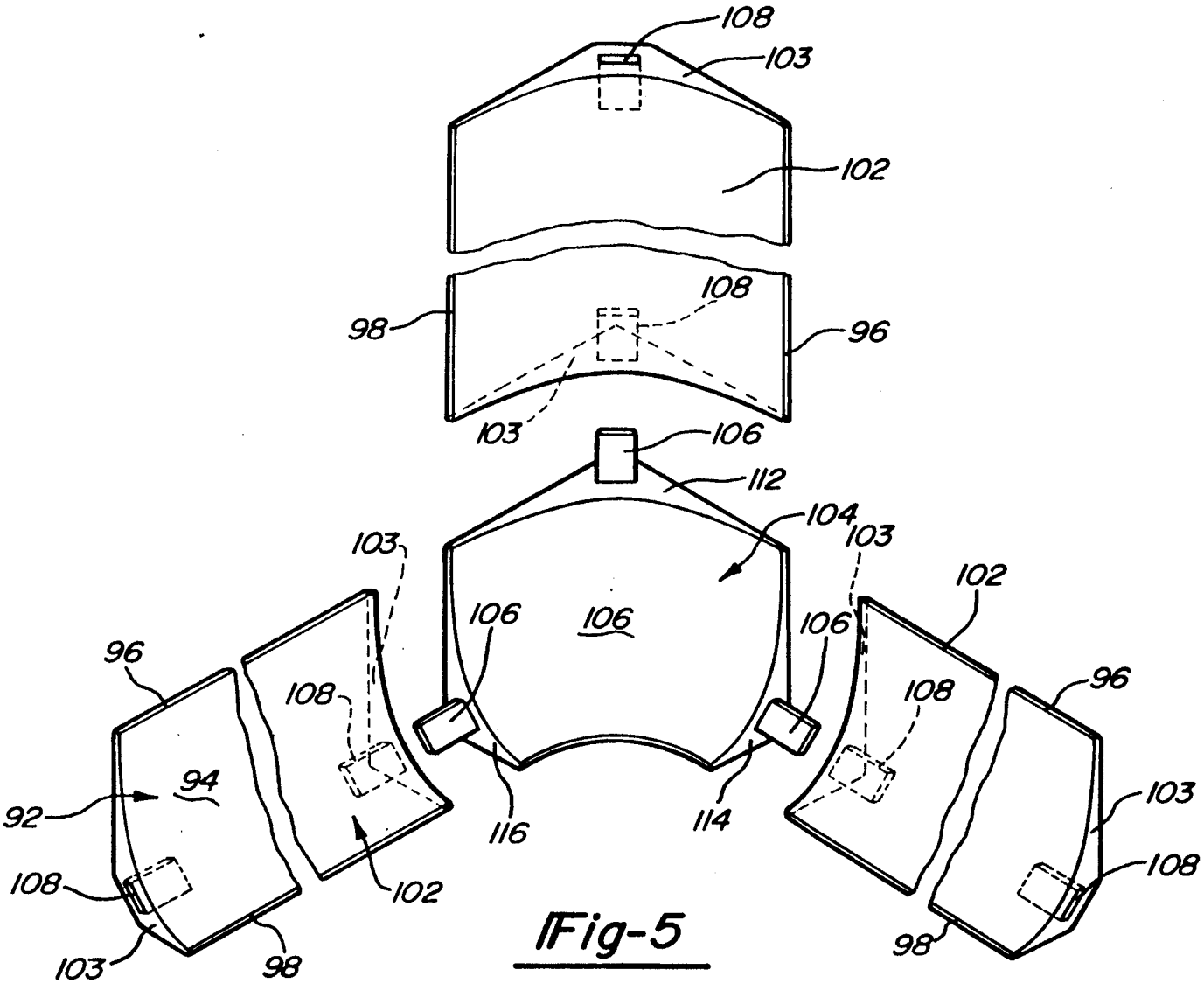
FIG. 5 is an exploded fragmentary perspective view of the cove molding used to finish the corners of the clean room.

With reference to FIG. 5, the cove 92 is shown in greater detail and illustrates cove strips 102 which are extruded of any length desired and are inserted into the corners between the side walls and floor, between adjacent side walls and between the side walls and ceiling. A corner block 104 having a radiused outer surface 106 is used for joining three mutually perpendicular cove strips 102 at a corner of the clean room. The corner block has three end surfaces 112, 114 and 116 for abutment with the three cove strips 102. To facilitate alignment of the radiused surface of the corner block with the radiused surface of the cove strips, tongues 106 are formed projecting from the end surfaces of the cove block 104 which are inserted into grooves 108 in the ends 103 of the cove strips. The corner blocks 104 and cove strips 102 are installed with a waterproof construction adhesive to secure the cove strips and blocks to the side walls, floor and ceiling. If desired, an optional recessed screw 110 can be used to install the cove strip or corner blocks as shown in FIG. 4.

The cove 92 in FIG. 4 is of a constant radius curvature extending from the floor vertically upward along the side wall the same distance which the cove extends from the side wall along the floor. A radius of between two and four inches is preferred. The larger the radius, the easier it is to clean. If desired, the cove used along the floor can be made of a varying radius such that the extension horizontally across the floor is somewhat less than the extension vertically up the wall. This will reduce the intrusion of the cove into the floor space of the clean room. Such a cove is shown in FIG. 5. A radius of one and one half inches at the floor proves satisfactory and can be blended into a four inch radius blending into the wall. However, the vertically extending cove strip between adjacent side walls should be made of a constant radius. In such a case, the curvature along the top end surface 112 of the corner block 104 would differ from the curvature along the two side end surfaces 114 and 116 as shown in FIG. 5.

The joint sealer 100 used to smooth the ends 98 and 96 of the cove strips is also used to seal seams between adjacent inner panels in the side walls and ceiling and to seal seams formed around the flange 74 of the air intake. Once the seams have been sealed, a coating 118 is applied to the floor, side walls, ceiling, air intake and cove to produce a continuous uninterrupted interior surface in the clean room that does not include any seams or crevices that can retain moisture and provide a site for bacteria growth. A suitable coating is an epoxy paint sold by General Polymer under the name Macroseptic which includes an antibacterial agent to retard bacteria growth. The epoxy paint is applied to a thickness of up to 3/16 of an inch, providing a durable long wearing surface for the clean room.

The laminate 32 forming the inner surface of the inner panels 24 as well as the laminate 49 forming the inner surface of the ceiling modules is preferably a rough textured laminate surface as opposed to a smooth glossy surface. Prior to assembly of the clean room the laminate is primed with an epoxy paint also containing an antibacterial agent. Once assembled, the coating 118 is then applied over the previously applied primer. The surface laminate is textured rather than glossy to facilitate the application of the epoxy paint to the laminate.

By virtue of the radiused corner transitions and the smooth air intake, the entire surface of the clean room can be easily washed with a sterilizing agent without any crevices that are hard to reach or seams that may retain moisture. The clean room of the present invention thus accomplishes the objective of providing a modularly constructed clean room with an interior surface free from seams or crevices thus enabling the room to be thoroughly washed and sterilized.

It is to be understood that the invention is not limited to the exact construction illustrated and described above, but that various changes and modifications may be made without departing from the spirit and scope of the invention as defined in the following claims.

I claim:

1. Modular clean room to form an environment isolated from ambient atmosphere to enable air within the environment to be maintained substantially free from contamination and substantially sterile comprising:

a plurality of vertical side walls extending upwardly from a substantially horizontal floor, said side walls constructed of a plurality of vertical wall modules positioned in side by side abutting relation along vertical edges of said modules to form each side wall, said modules each having an inner panel with the inner panels of adjacent modules being butted together along vertical edges forming a seam therebetween, said side walls being oriented normal to adjacent side walls;

a horizontal deck at the upper ends of said side walls for supporting air cleaning equipment;

a modular ceiling suspended from said deck having a plurality of ceiling modules, each ceiling module having an inner panel with said inner panels being in abutting relationship with adjacent inner panels forming seams therebetween;

molding means at right angle corners formed where adjacent side walls meet one another, where said side walls meet the floor and where said side walls meet said ceiling, said molding means forming a radiused surface merging tangentially with the floor, side walls and ceiling; and surface coating means on the floor, said inner panels, said molding means and said ceiling for forming a coating having a continuous inner surface in said room free from seams.

2. The modular clean room of claim 1 wherein said molding means includes elongated cove molding strips having a radiused surface merging substantially tangentially with said side walls, floor and ceiling whereby right angle corners are eliminated between said side wall, floor and ceiling and corner blocks having a radiused surface and three end surfaces lying in three mutually perpendicular planes for abutment with ends of three mutually perpendicular cove strips at the corners of said room where two adjacent side walls meet with the floor or ceiling.

3. The modular clean room of claim 2 further comprising a joint filler along said cove strips to smoothly merge said radiused cove strip surface into adjacent flat surfaces the floor, said side walls and said ceiling.

4. The modular clean room of claim 2 wherein said corner blocks include tongues extending outwardly from each of said end surfaces and said cove strips include grooves in the ends of said cove strips into which said tongues are inserted to align the radiused surface of said corner blocks with said radiused surface of said cove strips.

5. The modular clean room of claim 1 further comprising a joint sealer for filling seams formed between adjacent side wall and ceiling modules.

6. The modular clean room of claim 5 wherein said joint sealer is an epoxy.

7. The modular clean room of claim 1 wherein said coating means is an epoxy paint containing an anti-bacterial agent.

8. The modular clean room of claim 1 wherein the inner surface of said inner panels are covered with an epoxy paint primer prior to the application of said coating means.

9. A modular clean room to form an environment isolated from ambient atmosphere to enable the environment to be maintained substantially free from contamination and substantially sterile, comprising:

a plurality of upright side walls constructed of a plurality of vertical wall modules connected to one another along vertical side edges of said modules, said modules each having an upright framing member along said vertical side edges, an outer panel forming an exterior surface of said modules and an inner panel forming an interior surface of said modules, said inner panels of adjacent modules being butted together along vertical edges of said inner panels forming a seam therebetween, said side walls being oriented perpendicularly to adjacent side walls forming right angle corners between adjacent side walls;

a horizontal deck at the upper ends of said side walls for supporting air conditioning equipment;

a modular ceiling suspended from said deck and spaced therebelow forming a plenum between said deck and ceiling, said ceiling having a plurality of ceiling modules, said ceiling modules each having an inner panel with inner panels of adjacent ceiling modules being butted together forming a seam therebetween;

said side wall modules forming an air duct between said inner and outer panels and said framing members, an opening in said side wall modules forming an air inlet into said air duct at a lower end portion of said side wall module inner panels, said air duct being in communication with said plenum at the upper end of said side walls;

an air intake in said openings having a flange defining a vertical air duct inlet and a horizontal outlet within said module air duct, said flange being flush with said inner panel;

molding means at right angle corners formed where adjacent side walls meet one another, where said side walls meet the floor and where said side walls meet said ceiling, said molding means forming a radiused surface merging tangentially with the floor, side walls and ceiling; and surface coating means on the floor, said inner panels, said molding means, said air intakes and said ceiling for a forming coating having a continuous inner surface in said room free from seams.

10. The modular clean room of claim 9 wherein said intake is a one piece plastic molding having a bottom wall at the air inlet, said bottom wall curving gradually upwardly into a back wall at the horizontal outlet.

11. The modular clean room of claim 9 wherein said ceiling modules are formed with openings for light fixtures and air filters, said openings being framed by an inverted T-shaped channel members having an upright member and a lower cross member, said upright member being secured to a framing stud of said ceiling module with a portion of said cross-member overlying said coating and with the remainder of said cross member extending into the opening in said panel forming a ledge upon which said light fixtures and air filters can be supported.

12. The modular clean room of claim 11 wherein said channel members are mitered at the corners of said openings and adjacent channel members are welded together.

13. The modular clean room of claim 11 wherein said channel members are stainless steel.

14. The modular clean room of claim 9 wherein said molding means includes elongated cove molding strips having a radiused surface merging substantially tangentially with said side walls, floor and ceiling whereby right angle corners are eliminated between said side wall, floor and ceiling and corner blocks having a radiused surface and three end surfaces lying in three mutually perpendicular planes for abutment with ends of three mutually perpendicular cove strips at the corners of said room where two adjacent side walls meet with the floor or ceiling.

15. The modular clean room of claim 14 further comprising a joint filler along said cove strips to smoothly merge said radiused cove strip surface into adjacent flat surfaces at the floor, said side walls and said ceiling.

16. The modular clean room of claim 14 wherein said corner blocks include tongues extending outwardly from each of said end surfaces and said cove strips include grooves in the ends of said cove strips into which said tongues are inserted to align the radiused surface of said corner blocks with said radiused surfaces of said cove strips.

17. The modular clean room of claim 9 further comprising a stainless steel liner within said wall modules for said air duct and means for sealing said air intake at the outlet thereof to said stainless steel liner.

* * * * *